US008776294B1

(12) United States Patent
McCarty et al.

(10) Patent No.: US 8,776,294 B1
(45) Date of Patent: Jul. 15, 2014

(54) BRACKET FOR RETAINING MATTRESS

(71) Applicants: Philip Woods McCarty, Natick, MA (US); Philip Reid Sherman, Melville, NY (US); Chuan-Hang Shih, Lu-Kang (TW); Liang Liu, Lu-Kang (TW)

(72) Inventors: Philip Woods McCarty, Natick, MA (US); Philip Reid Sherman, Melville, NY (US); Chuan-Hang Shih, Lu-Kang (TW); Liang Liu, Lu-Kang (TW)

( * ) Notice: Subject to any disclaimer, the term of this patent is extended or adjusted under 35 U.S.C. 154(b) by 0 days.

(21) Appl. No.: 14/057,693

(22) Filed: Oct. 18, 2013

(30) Foreign Application Priority Data

Jul. 17, 2013 (TW) ..... 102213525 U

(51) Int. Cl.
*A47C 21/00* (2006.01)
*A47C 21/02* (2006.01)

(52) U.S. Cl.
CPC ..... *A47C 21/026* (2013.01)
USPC ..... 5/659; 5/658; 5/411; 5/193

(58) Field of Classification Search
USPC ..... 5/658, 659, 503.1–506.1, 411, 193
See application file for complete search history.

(56) References Cited

U.S. PATENT DOCUMENTS

| | | | | | |
|---|---|---|---|---|---|
| 1,072,490 | A * | 9/1913 | Oilar | 5/505.1 |
| 2,147,538 | A * | 2/1939 | Maguire et al. | 5/411 |
| 2,618,789 | A * | 11/1952 | Kane | 5/505.1 |
| 2,710,414 | A * | 6/1955 | Emery | 5/505.1 |
| 3,808,614 | A * | 5/1974 | Reinhard | 5/505.1 |
| 4,802,252 | A * | 2/1989 | Marmor | 5/505.1 |
| 6,895,615 | B2 * | 5/2005 | Dilascio | 5/505.1 |
| 6,901,616 | B1 * | 6/2005 | Warrington et al. | 5/505.1 |
| 7,607,181 | B1 * | 10/2009 | Harrison | 5/411 |
| 8,316,486 | B2 * | 11/2012 | Tipperreiter | 5/505.1 |
| 2003/0229942 | A1 * | 12/2003 | Dilascio | 5/505.1 |
| 2011/0314606 | A1 * | 12/2011 | Tipperreiter | 5/505.1 |

* cited by examiner

*Primary Examiner* — Robert G Santos
(74) *Attorney, Agent, or Firm* — Muncy, Geissler, Olds & Lowe, P.C.

(57) ABSTRACT

A bracket, which is adapted for retaining a mattress, includes two hinge bases for being mounted on a bed frame, two rotating members and a connector. Each of the rotating members has a pivot and a first coupling portion extending from the pivot and being substantially perpendicular to the pivot. The pivots are respectively connected with the hinge bases rotatably. The connector has a transverse portion and two second coupling portions respectively provided at two ends of the transverse portion and coupled with the first coupling portions. As a result, the connector can be easily dismounted from and mounted to the rotating members. When the connector is dismounted from the rotating members, the bed frame is conveniently wrapped and transported.

9 Claims, 6 Drawing Sheets

BRACKET FOR RETAINING MATTRESS

BACKGROUND OF THE INVENTION

1. Field of the Invention

The present invention relates generally to a bracket for retaining a mattress, which is adapted to be installed on a bed frame to prevent the mattress placed on the bed frame from displacement. The present invention relates more particularly to a bracket for retaining a mattress, which is conveniently disassembled from and assembled with the bed frame.

2. Description of the Related Art

Referring to FIG. 1, a conventional electrical bed 10 generally comprises a bed frame 11 having a plurality of angularly adjustable parts (not shown) and a bracket 12 installed at the rear end of the bed frame 11 for retaining a mattress 90. The bracket 12 comprises a retainer 13 and two fasteners 14. The retainer 13 comprises a flat-crowned U-shaped main body 15 and two bases 16 respectively and integrally connected with the bottom ends of the main body 15. The bases 16 are fixed to the bed frame 11 by means of the fasteners 14, respectively. As a result, the bracket 12 can limit the position of a mattress 90 placed on the bed frame 11 so that the mattress 90 will not displace relative to the bed frame 11 when the posture of the electrical bed 10 is inclinedly adjusted by means of the angularly adjustable parts.

As shown in FIG. 1, because the bracket 12 extends from the bed frame 11 upwards, the completely assembled electrical bed 10 is difficult to be wrapped and packed and a plurality of electrical beds 10 are difficult to be stacked upon one another, which causes inconvenience in storage and transportation. Therefore, many dealers in the industry dismounted the bracket 12 from the bed frame 11 before transporting the electrical bed 10. Under this circumstance, the consumers who bought the electrical beds would need to install the bracket 12 on the bed frame 11 by themselves. However, the installation process is in a way difficult, causing inconvenience to the consumers.

In other words, the conventional bracket 12 for retaining a mattress is inconvenient in usage because it makes the electrical bed 10 difficult to be wrapped, packed, stored and transported, or is not easy to be installed by the consumers.

SUMMARY OF THE INVENTION

The present invention has been accomplished in view of the above-noted circumstances. It is an objective of the present invention to provide a bracket for retaining a mattress, which is convenient in usage.

To attain the above objective, the present invention provides a bracket for retaining a mattress, which is adapted to be installed on a bed frame and comprises two hinge bases for being mounted on the bed frame, two rotating members and a connector. Each of the rotating members has a pivot and a first coupling portion extending from the pivot and being substantially perpendicular to the pivot. The pivots are connected with the hinge bases rotatably and respectively. The connector has a transverse portion and two second coupling portions respectively provided at two ends of the transverse portion and coupled with the first coupling portions.

As a result, a bed constructed by the bracket and the bed frame enables a mattress to be placed on the bed frame, and the bracket can prevent the mattress from displacement. The bed can be transported in a condition that the connector is dismounted from the rotating members and the rotating members are rotated to a state that the first coupling portions are appressed on the bed frame, which makes the bed convenient to be wrapped, packed, stacked and transported. After buying the beds equipped with the brackets of the present invention, the consumers only need to rotate the rotating members to another state that the first coupling portions stand vertically and then mount the connector on the rotating members to complete assembly of the bracket. This means that the bracket is easily assembled by the consumers without using any tools.

DETAILED DESCRIPTION OF THE INVENTION

Figure 1:
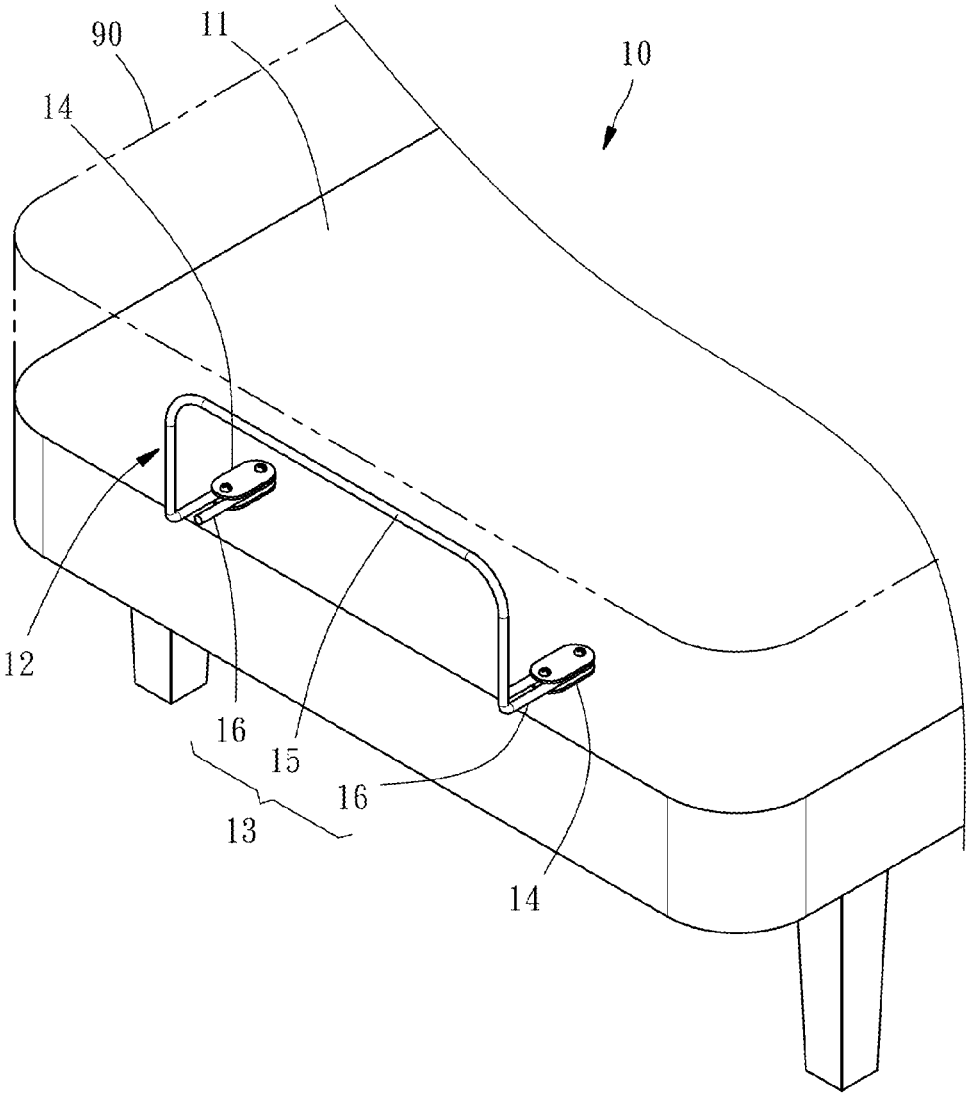
FIG. 1 PRIOR ART
FIG. 1 is a partially assembled perspective view of a bed frame, a mattress, and a conventional bracket for retaining the mattress.

In the following embodiments and figures, same reference numerals used designate same or similar elements or characteristics.

Figure 2:
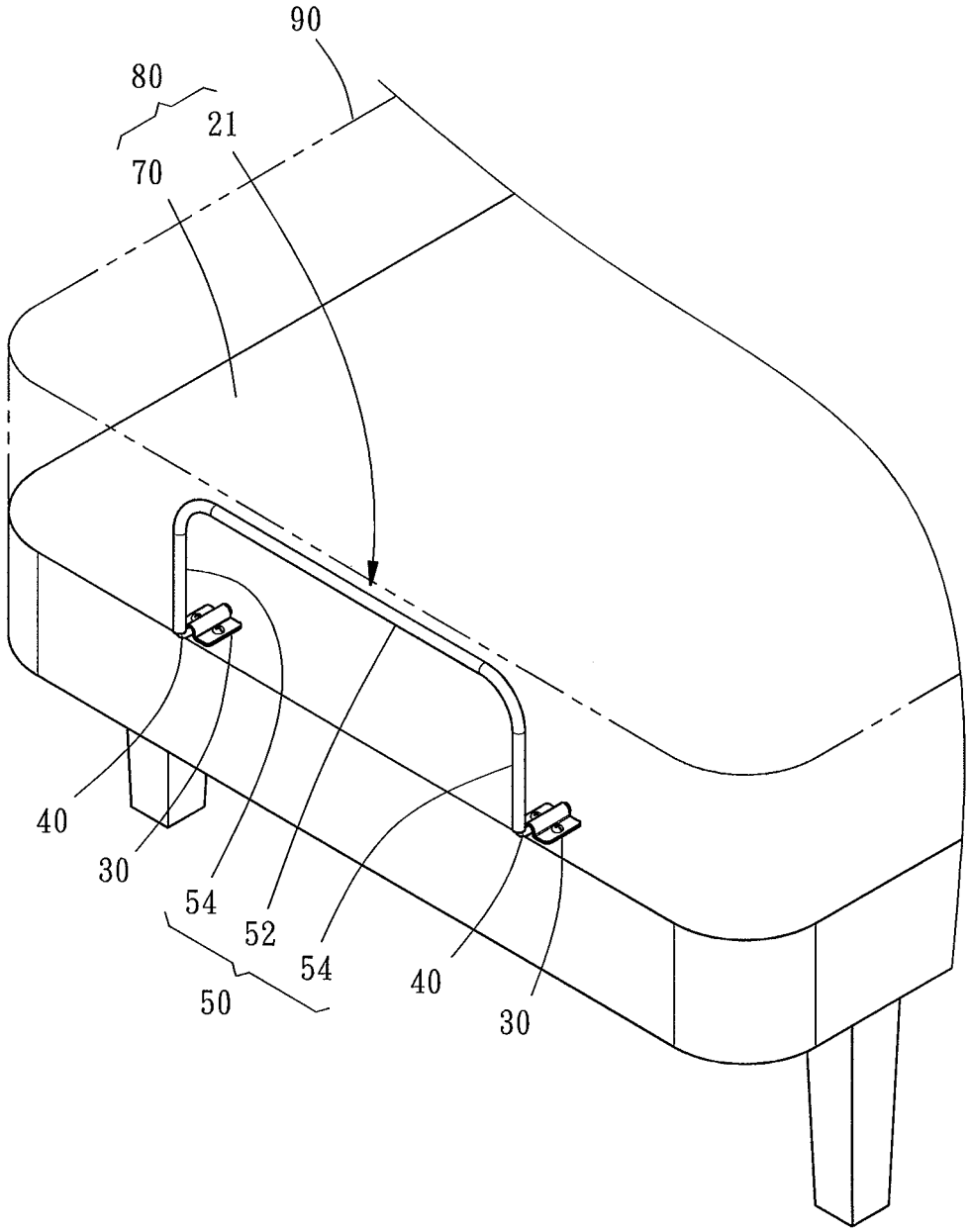
FIG. 2 is a partially assembled perspective view of a bed frame, a mattress and a bracket for retaining the mattress according to a first preferred embodiment of the present invention.
Figure 3:
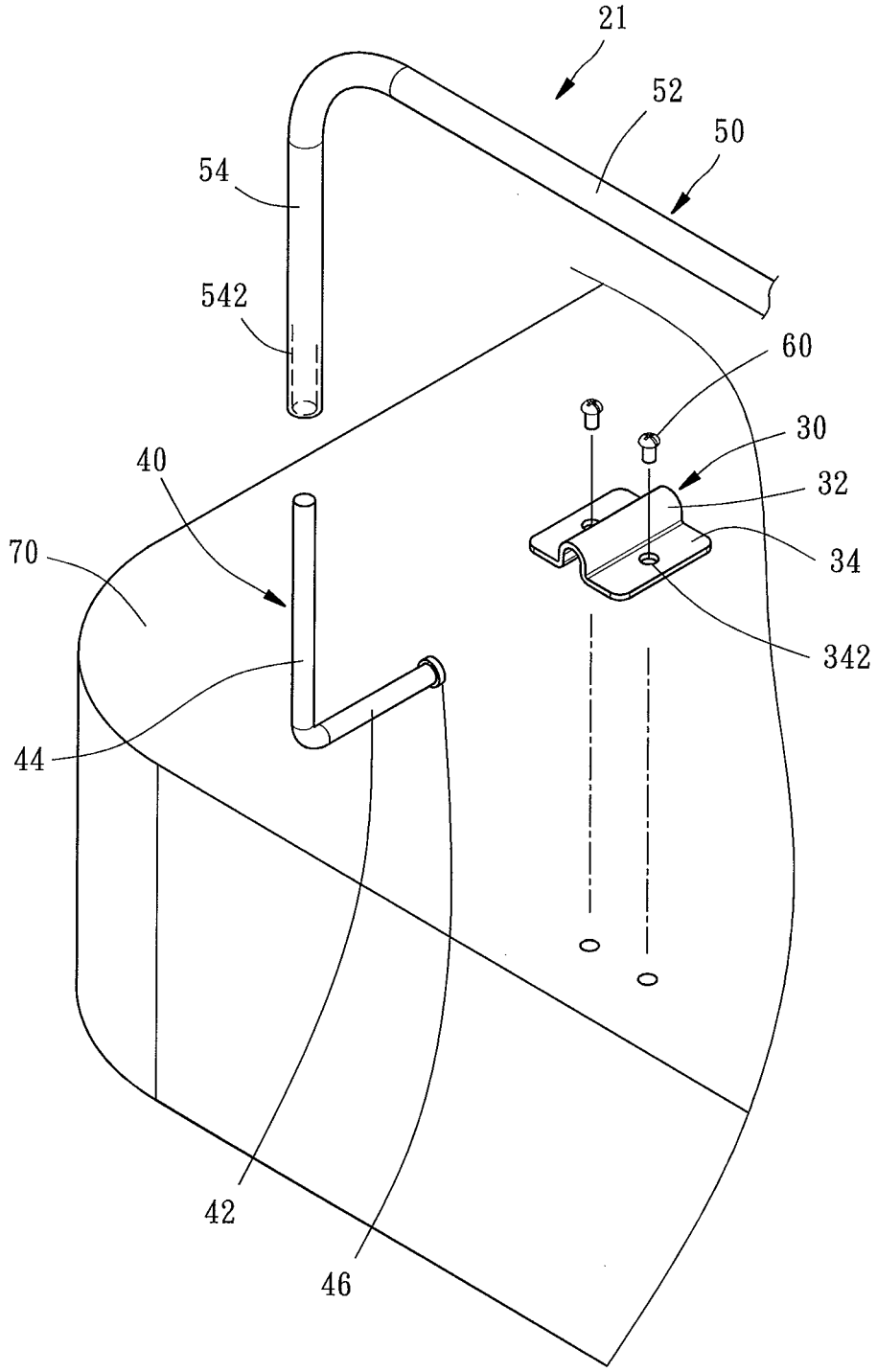
FIG. 3 is a partially exploded perspective view of the bed frame and the bracket for retaining the mattress of the first preferred embodiment of the present invention.

Referring to FIGS. 2-3, a bracket 21 for retaining a mattress according to a first preferred embodiment of the present invention comprises two hinge bases 30, two rotating members 40 and a connector 50. The bracket 21 is adapted to be installed on a bed frame 70 which is not entirely shown in the figures but only the rear part thereof is shown for the key points of the invention to be presented clearly and obviously.

Figure 4:
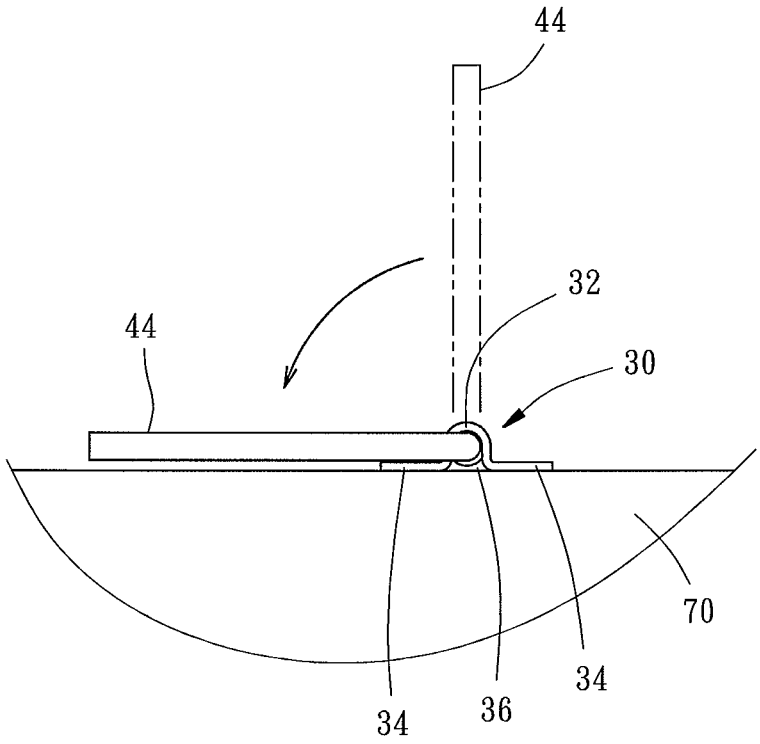
FIG. 4 is a partially front view of the bed frame and the bracket for retaining the mattress of the first preferred embodiment of the present invention.

Each of the hinge bases 30 is provided with an arched portion 32, which is a circularly arched plate, and two fixation portions 34, which are flat plates integrally extending from two ends of the arched portion 32, respectively. Each fixation portion 34 of each hinge base 30 is provided at a center thereof with a hole 342 and fastened to the bed frame 70 by means of a screw 60 passing through the hole 342 thereof. A passage 36 is formed between each arched portion 32 and the bed frame 70, as shown in FIG. 4.

Each of the rotating members 40 has a straight-column-shaped pivot 42 and a straight-column-shaped first coupling portion 44 extending from an end of the pivot 42 and being substantially perpendicular to the pivot 42. Besides, each of the rotating members 40 is provided with a head portion 46 located at the other end of the pivot 42 and having a larger radius than the pivot 42.

In the process of installing the bracket 21 on the bed frame 70, the rotating members 40 are put on the bed frame 70 at first, and then the pivots 42 of the rotating members 40 are covered by the arched portions 32 of the hinge bases 30, respectively; after that, the fixation portions 34 of the hinge bases 30 are fastened to the bed frame 70 so that the pivots 42 of the rotating members 40 are connected with the hinge bases 30 rotatably by passing through the passages 36 respectively and the head portions 46 of the rotating members 40 are exposed outside the hinge bases 30 and capable of preventing the pivots 42 from escaping from the passages 36.

It will be appreciated that each rotating member 40 can also be provided with no such head portion 46, and in this case the pivot 42 is prevented from escape out of the passage 36 by the friction force between the pivot 42 and the hinge base 30 as well as the friction force between the pivot 42 and the bed frame 70. Besides, the aforesaid process of installing the bracket 21 can be adopted in this embodiment because the arched portions 32 of the hinge bases 30 are open at their bottoms. However, the arched portions 32 of the hinge bases 30 can be configured to be closed at their bottoms; in this case, the hinge base 30 has itself the passage for the pivot 42 to pass through. Alternatively, the structure of the hinge base 30 can be replaced by other equivalent structures.

The connector 50 has a flat-crowned U-shaped profile and is provided with a transverse portion 52 and two second coupling portions 54 provided at two ends of the transverse portion 52, respectively. The second coupling portions 54 are substantially parallel to each other and perpendicular to the transverse portion 52. Each second coupling portion 54 is provided with a hole 542 extending inwardly from an end thereof. In an alternate design, the whole connector 50 can be made of a pipe with a flat-crowned U-shaped profile; in this case, the holes 542 of the second coupling portions 54 are communicated with each other. It will be appreciated that the shape of the connector 50 is not limited to be flat-crowned and U-shaped; in other words, it can be changed.

Under normal usage, the first coupling portions 44 of the rotating members 40 are posed vertically as shown in FIG. 3 and the second coupling portions 54 of the connector 50 are sleeved onto the first coupling portions 44, respectively. As a result, a bed 80 constructed by the bracket 21 and the bed frame 70 enables a mattress 90 to be placed on the bed frame 70 in such a way that the bracket 21 can prevent the mattress 90 from displacement relative to the bed frame 70.

To transport the bed 80, the connector 50 is dismounted from the rotating members 40 and the rotating members 40 are rotated to a state that the first coupling portions 44 are positioned horizontally and appressed on the top surface of the bed frame 70, as shown in FIG. 4, thereby making the bed 80 convenient to be wrapped, packed, stacked and transported. To assemble the bed 80, the consumers only need to rotate the rotating members 40 to pose the first coupling portions 44 vertically and then mount the connector 50 on the rotating members 40. This means that the bracket 21 is very easy to be assembled by the consumers without using any tools.

Figure 5:
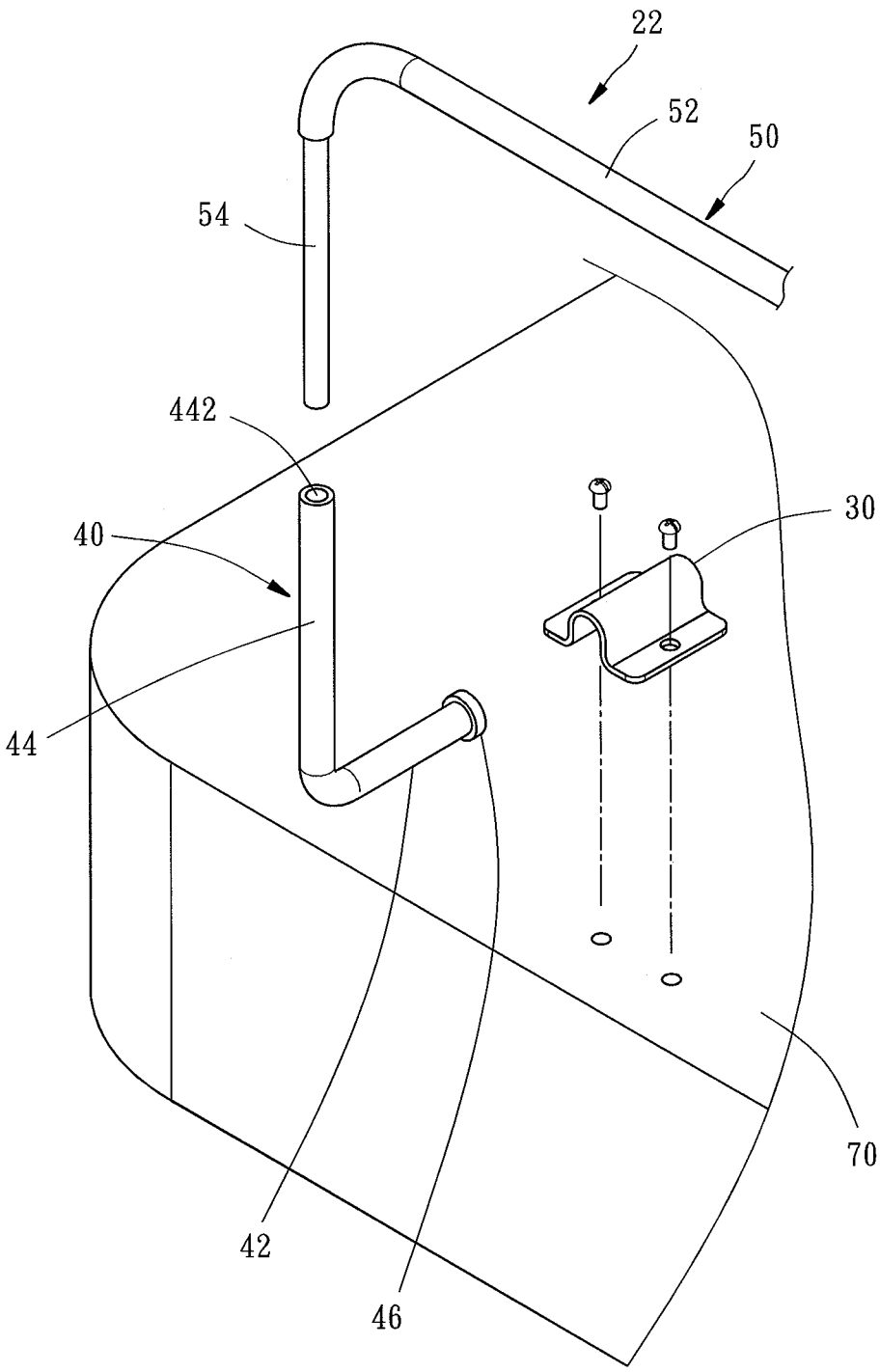
FIG. 5 is a partially exploded perspective view of a bed frame and a bracket for retaining a mattress according to a second preferred embodiment of the present invention.

Referring to FIG. 5, a bracket 22 for retaining a mattress according to a second preferred embodiment of the present invention is similar to the aforesaid bracket 21. However, in the bracket 22, the first coupling portion 44 of each of the rotating members 40 is tube-shaped and has a hole 442; the second coupling portions 54 of the connector 50 are column-shaped and able to be inserted into the holes 442 of the first coupling portions 44, respectively. The bracket 22 can achieve the same effects as the bracket 21 mentioned in the first preferred embodiment does.

Figure 6:
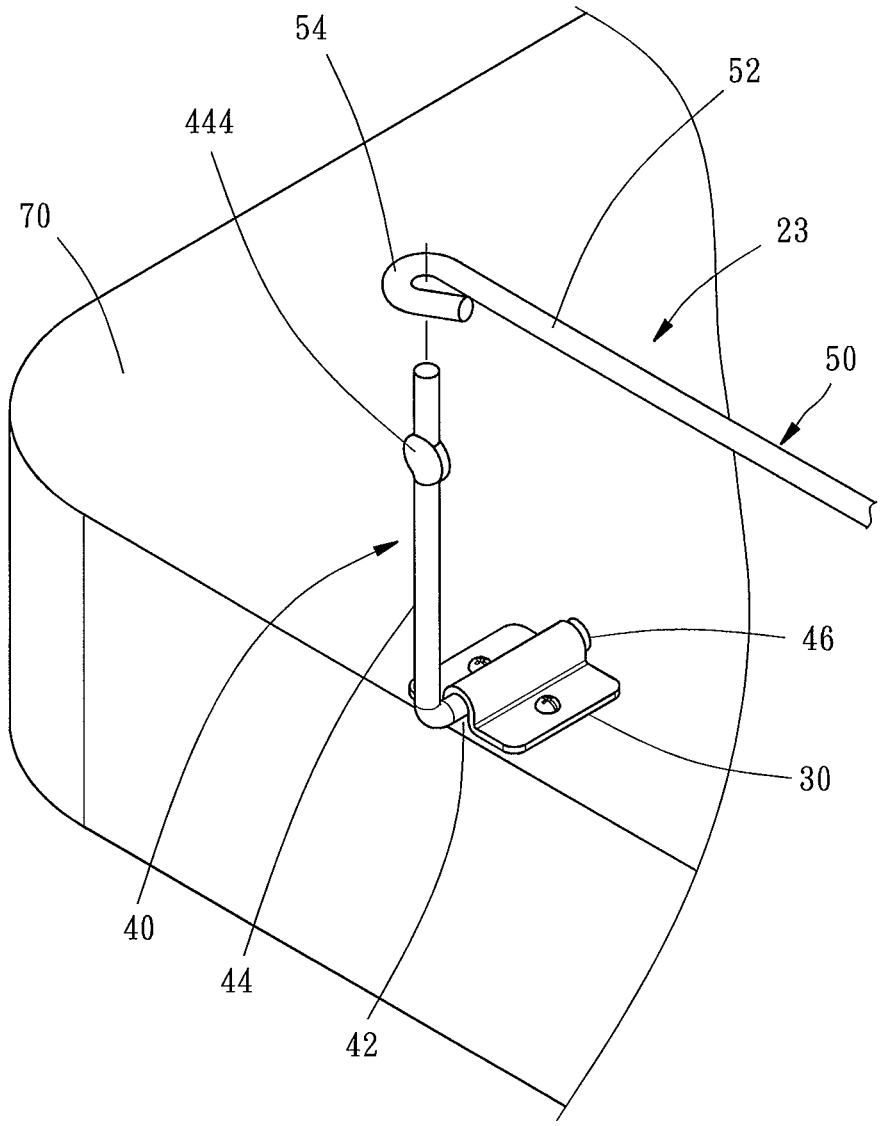
FIG. 6 is a partially exploded perspective view of a bed frame and a bracket for retaining a mattress according to a third preferred embodiment of the present invention.

Referring to FIG. 6, a bracket 23 for retaining a mattress according to a third preferred embodiment of the present invention is similar to the aforesaid bracket 21. However, in the bracket 23, the first coupling portion 44 of each of the rotating members 40 is provided with a stopping section 444; the second coupling portions 54 of the connector 50 are ring-shaped for being sleeved onto the first coupling portions 44 and abutted against the stopping sections 444 so as to be limited in position. The bracket 23 can achieve the same effects that the bracket 21 mentioned in the first preferred embodiment can achieve and can be made in a lower manufacturing cost.

In conclusion, the bracket provided by the present invention has the connector, which is easy to be dismounted from and mounted to the rotating members, and the rotating members, which can be selectively rotatable to a vertical posture or a horizontal posture, so that the bed with the bracket of the present invention can be transformed into a configuration that can be easily wrapped, packed, stored and transported when the connector is dismounted from the rotating members. In addition, the design of the present invention enables the consumer to easily assemble the bracket without using any tools.

What is claimed is:

1. A bracket (21, 22, 23) for being installed on a bed frame (70) for retaining a mattress, the bed frame having a top surface, the bracket (21, 22, 23) comprising:

two hinge bases (30) for being mounted on the bed frame and adjacent to a rear edge of the top surface;

two rotating members (40) each having a pivot (42) and a first coupling portion (44) extending from the pivot and being substantially perpendicular to the pivot, the pivots being rotatably connected with the hinge bases about respective parallel horizontal axes, the pivots each having a longitudinal axis extending in a direction perpendicular to the rear edge, the rotating members each being rotatable about the respective pivot longitudinal axis; and a connector (50) having a transverse portion (52) and two second coupling portions (54) respectively provided at two ends of the transverse portion and coupled with the first coupling portions.

2. The bracket as claimed in claim 1, wherein each of the hinge bases is provided with an arched portion (32); a passage (36) is formed between each said arched portion and the bed frame; the pivots of the rotating members pass through the passages, respectively.

3. The bracket as claimed in claim 2, wherein each of the rotating members is provided with a head portion (46) located at an end of the pivot and exposed outside the hinge base.

4. The bracket as claimed in claim 2, wherein each of the hinge bases is provided with two fixation portions (34) extending from two ends of the arched portion for being fastened to the bed frame.

5. The bracket (21) as claimed in claim 1, wherein each of the second coupling portions is provided with a hole (542) into which one of the first coupling portions is inserted.

6. The bracket (22) as claimed in claim 1, wherein the first coupling portion of each of the rotating members is provided with a hole (442) into which one of the second coupling portions is inserted.

7. The bracket as claimed in claim 1, wherein the second coupling portions are substantially parallel to each other and perpendicular to the transverse portion.

8. The bracket (23) as claimed in claim 1, wherein the first coupling portion of each of the rotating members is provided with a stopping section (444); the second coupling portions of the connector are abutted against the stopping sections, respectively.

9. A bracket (21, 22, 23) for being installed on a bed frame (70) for retaining a mattress, the bracket (21, 22, 23) comprising:

two hinge bases (30) for being mounted on the bed frame;

two rotating members (40) each having a pivot (42) and a first coupling portion (44) extending from the pivot and being substantially perpendicular to the pivot, the pivots being rotatably connected with the hinge bases, respectively; and a connector (50) having a transverse portion (52) and two second coupling portions (54) respectively provided at two ends of the transverse portion and coupled with the first coupling portions;

wherein a passage (36) is formed between each said hinge base and the bed frame; the pivots of the rotating members pass through the passages, respectively; each of the rotating members is provided with a head portion (46) located at an end of the pivot and exposed outside the hinge base, each of the head portions has a larger radius than the pivot.

* * * * *